US009739502B2

(12) United States Patent
Luppold et al.

(10) Patent No.: US 9,739,502 B2
(45) Date of Patent: Aug. 22, 2017

(54) METHOD FOR MANUFACTURING AN ELECTRICAL HEATING DEVICE AND HEATING DEVICE

(71) Applicant: BorgWarner Ludwigsburg GmbH, Ludwigsburg (DE)

(72) Inventors: Michael Luppold, Dettenheim (DE); Alexander Dauth, Maulbronn (DE); Klaus Lehmann, Oberderdingen (DE); Bernd Halbrock, Königsbach-Stein (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 343 days.

(21) Appl. No.: 14/522,785

(22) Filed: Oct. 24, 2014

(65) Prior Publication Data

US 2015/0117848 A1 Apr. 30, 2015

(30) Foreign Application Priority Data

Oct. 30, 2013 (DE) ..... 10 2013 111 987

(51) Int. Cl.

| | |
|---|---|
| ***F24H 9/12*** | (2006.01) |
| ***F24H 1/10*** | (2006.01) |
| ***B21D 53/08*** | (2006.01) |
| *F24H 3/04* | (2006.01) |

(52) U.S. Cl.

CPC ..... *F24H 1/102* (2013.01); *B21D 53/08* (2013.01); *F24H 3/0435* (2013.01); *Y10T 29/49373* (2015.01)

(58) Field of Classification Search

None

See application file for complete search history.

(56) References Cited

U.S. PATENT DOCUMENTS

| | | | | |
|---|---|---|---|---|
| 5,057,672 | A * | 10/1991 | Bohlender | F24H 3/0405 219/202 |
| 5,192,853 | A * | 3/1993 | Yeh | H05B 3/141 219/505 |
| 5,256,857 | A * | 10/1993 | Curhan | F24H 3/0411 219/202 |
| 5,562,844 | A * | 10/1996 | Bohlender | F24H 3/0405 219/505 |
| 5,995,711 | A * | 11/1999 | Fukuoka | B60H 1/00328 219/202 |
| 6,055,360 | A * | 4/2000 | Inoue | B60H 1/00321 165/151 |
| 6,178,292 | B1 * | 1/2001 | Fukuoka | F24H 1/009 165/175 |

(Continued)

FOREIGN PATENT DOCUMENTS

WO WO 2007/071335 A1 6/2007

*Primary Examiner* — Thor Campbell

(74) *Attorney, Agent, or Firm* — Bose McKinney & Evans LLP

(57) ABSTRACT

What is described is a method for manufacturing an electrical heating device, wherein electrical heating resistors are disposed in tubes of an extruded profile, and openings are cut into a plate of the extruded profile connecting the tubes. According to this disclosure, fastening sections of the extruded profile are plastically deformed and, by means thereof, heat sinks are fastened on the extruded profile. A corresponding electrical heating device is also described.

11 Claims, 3 Drawing Sheets

(56) References Cited

U.S. PATENT DOCUMENTS

| | | | | |
|---|---|---|---|---|
| 6,259,075 | B1 * | 7/2001 | Wu | H05B 3/141 219/540 |
| 6,472,645 | B1 * | 10/2002 | Bohlender | F24H 3/0429 219/505 |
| 6,723,966 | B2 * | 4/2004 | Jiang | F24H 9/1863 219/505 |
| 7,200,327 | B2 * | 4/2007 | Pierron | B60H 1/2225 165/148 |
| 7,297,901 | B2 * | 11/2007 | Lee | B60H 1/2225 219/202 |
| 7,482,557 | B2 * | 1/2009 | Clemens | F24H 3/0405 219/530 |
| 7,971,799 | B2 * | 7/2011 | Colette | B60H 1/2225 165/41 |
| 7,977,610 | B2 * | 7/2011 | Hamburger | H05B 3/06 219/504 |
| 8,319,158 | B2 * | 11/2012 | Bohlender | F24H 3/0405 219/202 |
| 8,395,089 | B2 * | 3/2013 | Bohlender | B60H 1/2225 219/202 |
| 8,395,097 | B2 * | 3/2013 | Bohlender | F24H 3/0405 219/202 |
| 2009/0139983 | A1 | 6/2009 | Luppold et al. | |

* cited by examiner

METHOD FOR MANUFACTURING AN ELECTRICAL HEATING DEVICE AND HEATING DEVICE

RELATED APPLICATIONS

This application claims priority to DE 10 2013 111 987.5, filed Oct. 30, 2013, which is hereby incorporated herein by reference in its entirety.

BACKGROUND

The invention relates to a method for manufacturing an electrical heating device of the type generally known from WO 2007/071335 A1.

WO 2007/071335 A1 discloses electrical heating devices comprising a housing, which is produced from an extruded profile. The extruded profile comprises a plurality of tubes that are connected by one or two plates extending between each tube. Openings are cut into the plates. Fluid to be heated can flow through the openings and thereby absorb heat generated by heating resistors disposed in the tubes.

One advantage of such heating devices is that the heating resistors are protected by the tubes. Accidents resulting from inadvertent contact with the heating resistors are therefore practically impossible. In addition, the heating resistors are protected from the fluid to be heated. A disadvantage, however, is a high flow resistance of the heat dissipation plates between the tubes. Although this flow resistance can be reduced by increasing the number or the surface area of the openings, this increasingly diminishes the heat transfer.

SUMMARY

This disclosure teaches a method to cost-effectively produce an electrical heating device, in which the heating resistors are disposed in tubes in a protected manner, and which combines low flow resistance with good heat dissipation.

In a method according to this disclosure, a profile is provided comprising a plurality of tubes and at least one plate connecting the tubes. Electrical heating resistors are disposed in the tubes of the extruded profile and openings are cut into the plate connecting the tubes. Heat sinks are connected to the tubes for the purpose of heat dissipation. The heat sinks are fastened by means of plastically deforming fastening sections of the extruded profile.

Blades that are cut out of the plate and are folded upright can be used as fastening sections. The blades are made of the material of the plate in the region of the openings. The blades can be bent around the heat sinks in order to hold said heat sinks in a clamping manner. The blades are plastically deformed when bent.

Alternatively or in addition thereto, flanges extending from the tubes can also be used as fastening sections. Each heat sink is then placed between the plate and a flange extending from one of the tubes, and the flange or the section of the plate opposite thereof is plastically deformed.

In the method according to this disclosure, the heating resistors can be placed in the tubes and then the openings can be cut out, or the openings can be cut out and then the heating resistors can be placed in the tubes. The plastic deformation of the fastening sections can take place before or after the heating resistors are placed in the tubes. The tubes can be compressed after the heating resistors have been placed in the tubes. Thereby the thermal coupling of the heating resistors onto the tubes can be improved. Such compressing of the tubes can take place simultaneously with the plastic deformation of the flanges.

The heat sinks, which are, for example, strips of sheet metal bent in a serpentine shape, provide a large heat dissipation surface in combination with low flow resistance. The plate of the extruded profile is therefore no longer needed for heat dissipation, but rather only for connecting adjacent tubes to one another. The openings in the plate can therefore be designed to have such a large surface area that only a few webs remain, which connect adjacent tubes to one another. The flow resistance of these webs is advantageously low, and so, overall, the heating device combines low flow resistance with good heat dissipation.

The heat sinks can be retained on the tubes between the webs and a flange. In order to produce the heating device, the heat sinks are placed on the tubes, between the webs and the flange, and then the flange is plastically deformed. In the plastic deformation of the flange, a section of the underlying heat sink can also be deformed.

The flange can be plastically deformed, for example, by bending said flange such that it engages around an edge of the heat sink. Depending on the nature of the heat sink, the flange can be bent over along the entire length thereof or only in individual sections. If strips of sheet metal bent in a serpentine shape are used as heat sinks, it can be advantageous, for example, for bent-over flange sections to each engage into a curve of the sheet metal strips. The flange can have incisions between the curved sections in order to simplify the bending.

One way to fasten the heat sinks on the tubes is to plastically deform the flange by embossing, stamping or crimping. A section of the heat sink located underneath the flange can also be plastically deformed thereby. For example, a die can be used to stamp a series of recesses into the flange, which produce corresponding raised areas on the underside of the flange and clamp the heat sinks or engage therein.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
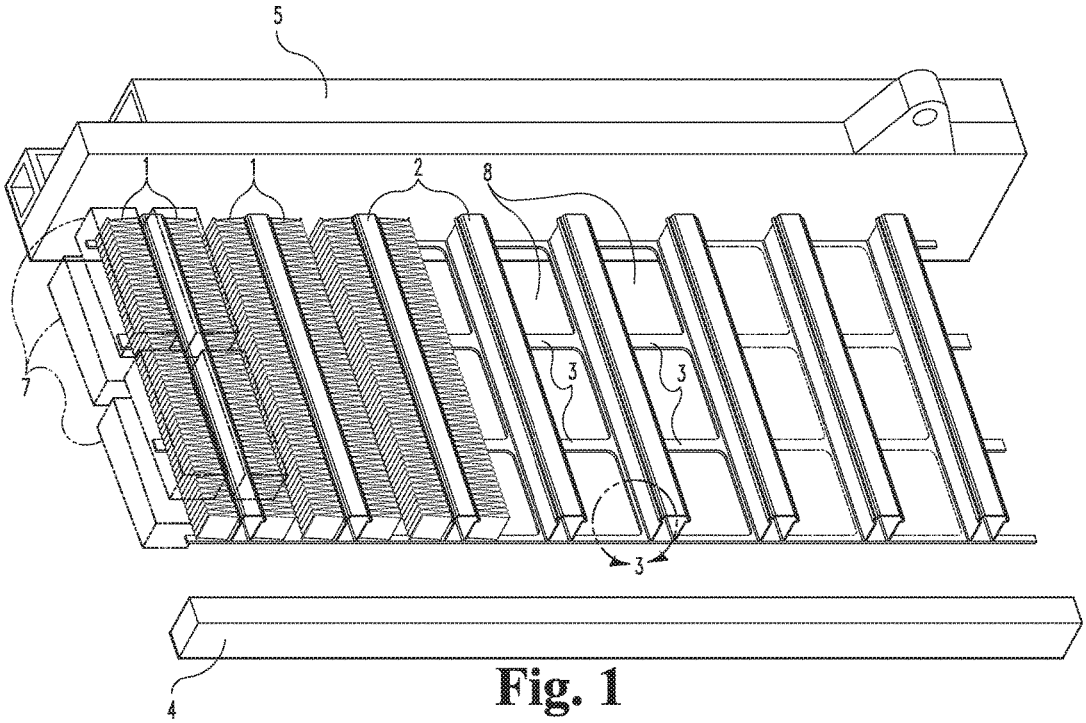
FIG. 1 shows a schematic depiction of an electrical heating device.
Figure 2:
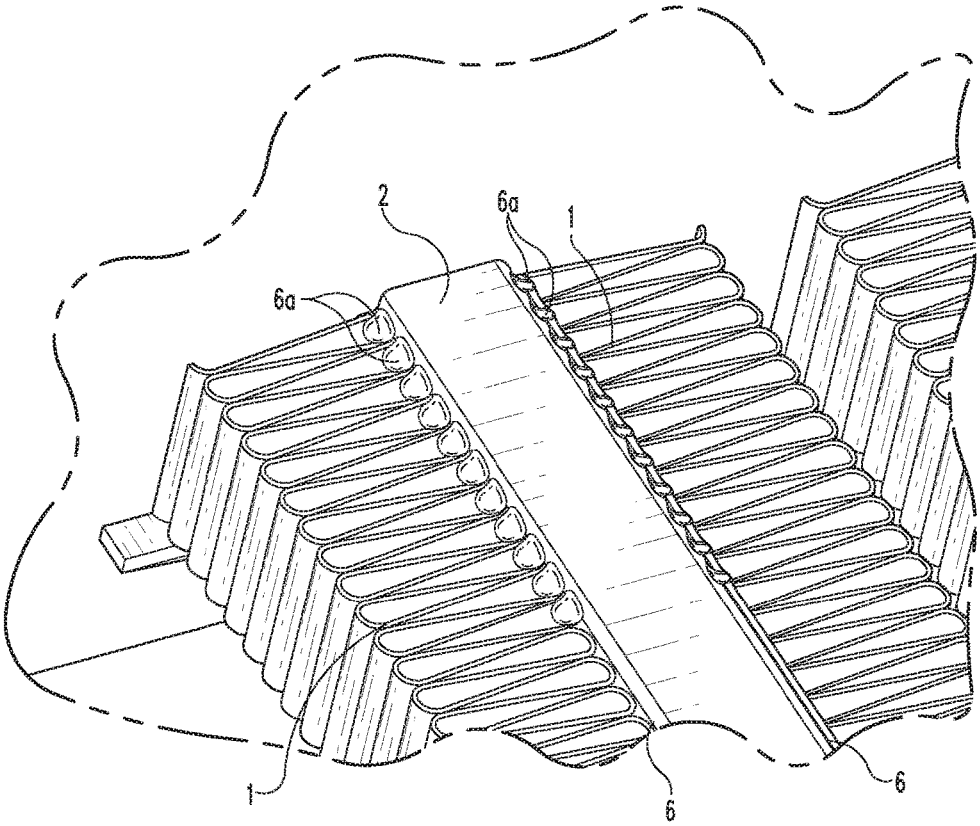
FIG. 2 shows a detailed view of FIG. 1.

The heating device depicted in FIGS. 1 and 2 comprises heat sinks 1, which are fastened on tubes 2, in each of which one or more heating resistors, for example, ceramic PTC elements, are disposed. The tubes 2 are connected to one another by webs 3. The tubes 2 can be fastened at one end to a base 4 and/or can carry an attachment 5 at the other end, wherein said attachment can contain electrical connections and/or control electronics.

The heat sinks 1 are each fastened on the tubes 2, between the webs 3 and a flange 6. The tubes 2 can comprise a flange 6, as a fastening section, on two opposing sides. After a heat sink 1 is set in place, the flange 6 is plastically deformed, for example, using a pressing or stamping tool 7 depicted schematically in FIG. 1. As shown in FIG. 2, after such plastic deformation, sections 6*a* of the flange 6 can engage around an edge of the heat sink 1. When the flange 6 is plastically deformed, the underlying heat sink 1 can also be plastically deformed.

Strips of sheet metal bent in a serpentine shape, for example, can be used as the heat sinks 1.

The tubes 2, the flange 6 thereof, and the webs 3 are produced as an extruded profile, wherein openings 8 were cut into a plate connecting the tubes 2. The webs 3 are what remains of this plate after the openings are cut out. The total surface area of the openings 8 is preferably greater than the remaining surface area of the plate, i.e., greater than the total surface area of the webs 3. For example, the total surface area of all openings 8 can be more than twice the total surface area of all webs 3.

The webs 3 extend between lateral surfaces of the tubes 2. The tubes 2 can be embodied as square tubes. In this case, the webs 3 are positioned perpendicularly on the lateral surfaces. The webs 3 can be disposed on a tube edge. It is also possible for the webs 3 to be positioned on a lateral surface of one of the tubes 2 at a distance from the two edges that limit this lateral surface. FIG. 1 depicts different stages of manufacturing. The webs 3 are show in phantom on the right, whereas the cutouts 8 are shown near the center of FIG. 1. On the left side of FIG. 1, the heat sinks 1 are shown and on the far left side the stamping tools 7 are depicted.

Figure 3:
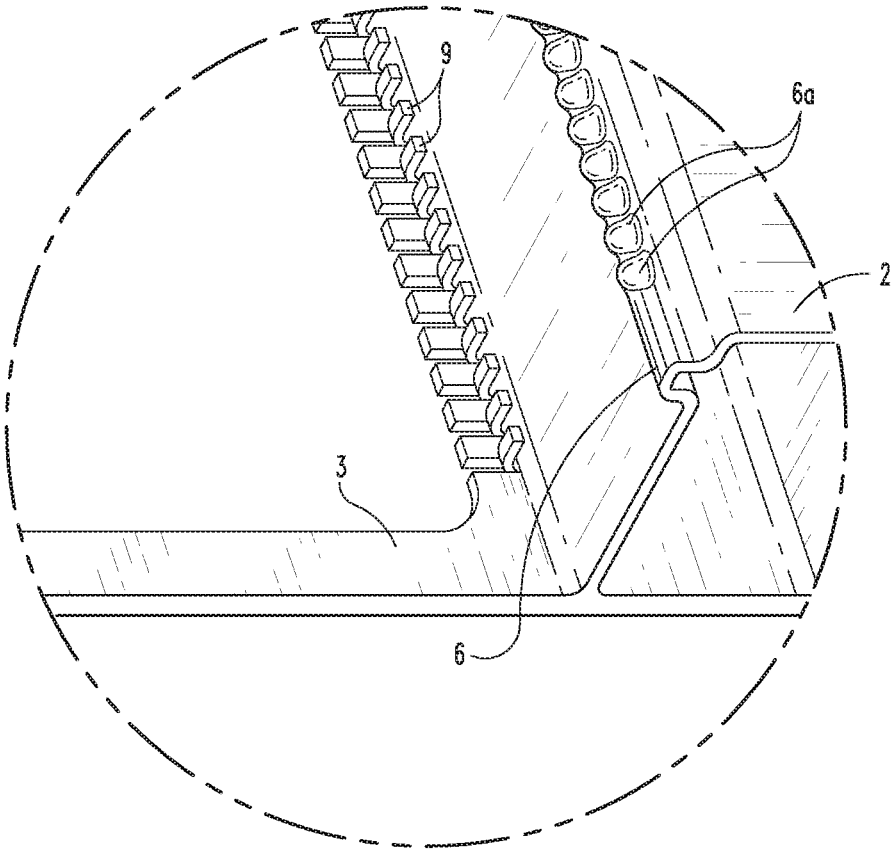
FIG. 3 shows a detailed view of a further embodiment in which the heat sinks are retained by blades.

Alternatively or in addition thereto, the heat sinks 1 in the above-described heating device can also be retained by blades 9, which are formed of the material of the plate in the region of the openings 8. This region is circled in FIG. 1 and this optional feature is depicted in FIG. 3. The blades 9 are cut out of the plate, as fastening sections, and are then folded upright and are bent to hold the heat sinks 1, as depicted schematically in FIG. 3.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

What is claimed is:

1. A method for manufacturing an electrical heating device, comprising:

providing an extruded profile comprising tubes and a plate connecting the tubes;

arranging electrical heating resistors in the tubes of the extruded profile;

cutting openings into the plate of the extruded profile; and fastening heat sinks on the extruded profile by plastically deforming fastening sections of the extruded profile.

2. The method according to claim 1, wherein the fastening sections are blades, which are cut out of the plate, then folded upright in order to form the openings and, after plastic deformation, retain the heat sinks by clamping.

3. The method according to claim 1, wherein the fastening sections are regions of the plate adjoining the tubes or are flanges extending from the tubes, and the heat sinks are fastened on the tubes by placing each heat sink between the plate and one of the flanges, and then deforming the flange or the region adjoining the tube plastically.

4. The method according to claim 1, wherein the heat sink is sheet metal bent in a serpentine shape.

5. The method according to claim 1, wherein the fastening sections are bent over an edge of the heat sinks for fastening the heat sinks.

6. The method according to claim 1, wherein the total surface area of the cut-out openings is larger than the remaining surface area of the plate.

7. A heating device, comprising:

electrical heating resistors;

tubes in which the heating resistors are disposed;

the tubes comprising webs connecting the tubes;

heat sinks bearing against the tubes; and fastening sections extending from the webs or the tubes, the fastening sections retaining the heat sinks on the webs.

8. The heating device according to claim 7, wherein at least some of the fastening sections are blades, which extend from the webs and retain the tubes.

9. The electrical heating device according to claim 7, wherein at least some of the fastening sections are flanges extending from the tubes, wherein each of the heat sinks is retained by one of the flanges and the webs.

10. The electrical heating device according to claim 7, wherein the tubes, flanges, and webs were produced as a single piece from an extruded profile, wherein openings were cut into a plate connecting the tubes, thereby forming the webs out of the plate.

11. The electrical heating device according to claim 7, wherein the webs connect lateral surfaces of the tubes.

* * * * *